US009512658B2

(12) United States Patent
Balbo Di Vinadio

(10) Patent No.: US 9,512,658 B2
(45) Date of Patent: Dec. 6, 2016

(54) DEVICE FOR OPENING AND CLOSING A PIVOTING WING

(71) Applicant: SAVIO S.p.A., Chiusa San Michele (IT)

(72) Inventor: Aimone Balbo Di Vinadio, Chiusa San Michele (IT)

(73) Assignee: SAVIO S.p.A., Chiusa San Michele (IT)

( * ) Notice: Subject to any disclaimer, the term of this patent is extended or adjusted under 35 U.S.C. 154(b) by 0 days.

(21) Appl. No.: 14/279,518

(22) Filed: May 16, 2014

(65) Prior Publication Data

US 2015/0013230 A1 Jan. 15, 2015

(30) Foreign Application Priority Data

Jul. 5, 2013 (IT) ..... TO2013A0563

(51) Int. Cl.

| | |
|---|---|
| ***E05F 11/28*** | (2006.01) |
| ***E05D 15/44*** | (2006.01) |
| ***E05F 11/26*** | (2006.01) |
| ***E05F 7/08*** | (2006.01) |
| ***E06B 3/36*** | (2006.01) |

(Continued)

(52) U.S. Cl.

CPC ..... *E05F 11/28* (2013.01); *E05D 15/44* (2013.01); *E05F 7/08* (2013.01); *E05F 11/26* (2013.01); *E06B 3/36* (2013.01); *E05D 15/408* (2013.01); *E05F 11/10* (2013.01); *E05Y 2201/638* (2013.01); *E05Y 2900/148* (2013.01)

(58) Field of Classification Search

CPC ..... E05F 11/08; E05F 11/10; E05F 11/12; E05F 11/24; E05F 11/26; E05F 11/28;E05F 7/08; E06B 3/34; E06B 3/36; E05D 15/44

See application file for complete search history.

(56) References Cited

U.S. PATENT DOCUMENTS

| | | | | |
|---|---|---|---|---|
| 2,709,582 | A * | 5/1955 | Chapman | 49/81.1 |
| 8,528,255 | B2 * | 9/2013 | Lambertini | 49/192 |
| 2005/0066579 | A1 * | 3/2005 | Winner | 49/345 |

(Continued)

FOREIGN PATENT DOCUMENTS

| | | | | |
|---|---|---|---|---|
| CH | 410666 | | 3/1966 | |
| DE | 1087043 B | * | 8/1960 | E05F 11/24 |

(Continued)

OTHER PUBLICATIONS

Italian Search Report and Written Opinion for Application No. TO2013A000563 dated Oct. 18, 2013.

*Primary Examiner* — Brian Mattei
*Assistant Examiner* — Catherine A Kelly
(74) *Attorney, Agent, or Firm* — Patterson & Sheridan, LLP

(57) ABSTRACT

A device for opening and closing a pivoting wing, comprising: a stationary support intended to be attached to a fixed frame, a slide movable relative to the stationary support along a rectilinear direction between an open wing position and a closed and locked wing position, a pivoting arm articulated to the stationary support about an articulation axis, and having a distal end intended to be connected to the wing, a transmission mechanism associated with the slide and the arm, comprising an essentially L-shaped cam engaged by a control pin, the transmission mechanism being configured to transform the rectilinear movement of the slide along said rectilinear direction into a pivoting movement of the arm about said pivot axis.

6 Claims, 8 Drawing Sheets

(51) Int. Cl.

| | |
|---|---|
| *E05D 15/40* | (2006.01) |
| *E05F 11/10* | (2006.01) |

(56) References Cited

U.S. PATENT DOCUMENTS

2006/0048450 A1 3/2006 Curtis et al.

FOREIGN PATENT DOCUMENTS

| | | | |
|---|---|---|---|
| DE | 2106569 | | 8/1972 |
| DE | 2705965 | * | 8/1978 |
| EP | 0416149 | | 3/1991 |
| EP | 0531626 | * | 3/1993 |

* cited by examiner

DEVICE FOR OPENING AND CLOSING A PIVOTING WING

CROSS-REFERENCE TO RELATED APPLICATIONS

This application claims benefit of Italian patent application number TO2013A000563, filed Jul. 5, 2013, which is herein incorporated by reference.

BACKGROUND OF THE INVENTION

Field of the Invention

The present invention relates to accessories for doors and windows and refers to a device for opening and closing a wing, in particular an outwardly-opening pivoting wing. The device according to the invention can be applied to wings articulated about vertical axes or to wings rotatable about horizontal axes.

Description of Prior Art

Outwardly-opening pivoting wings are sometimes associated with insect screens. In these cases, the device that controls the opening and closing of the wing must be arranged so as not to interfere with the insect screen, to allow the opening and closing of the wing without prior lifting or removal of the insect screen. In these applications, devices are used for opening and closing the wing that are mounted on the frame.

CH410666 describes a device for opening and closing a pivoting wing, comprising a stationary support attached to the frame, a slide movable relative to the stationary support in a rectilinear direction between an open wing position and a closed wing position, an arm articulated to the stationary support about an articulation axis and having a distal end that slides in a groove of the wing, wherein the slide has a control pin, which engages a cam formed in the arm.

A drawback of this known solution is that, during closing of the wing, it is necessary to apply a very high torque to the arm when the door is near to the frame to compress the seals, which are usually arranged between the wing and the frame. This causes a high stress of the control pin and the pivot pin, which are therefore subject to a high risk of fatigue failure.

SUMMARY OF THE INVENTION

The present invention aims to provide a device for opening and closing an outwardly-opening pivoting wing that can overcome the drawbacks of the known solutions.

According to the present invention, this object is achieved by a device having the characteristics forming the subject of claim 1.

The claims form an integral part of the disclosure provided in relation to the invention.

BRIEF DESCRIPTION OF THE DRAWINGS

The present invention will now be described in detail with reference to the accompanying drawings, given purely by way of non-limiting example, wherein.

DETAILED DESCRIPTION

Figure 1:
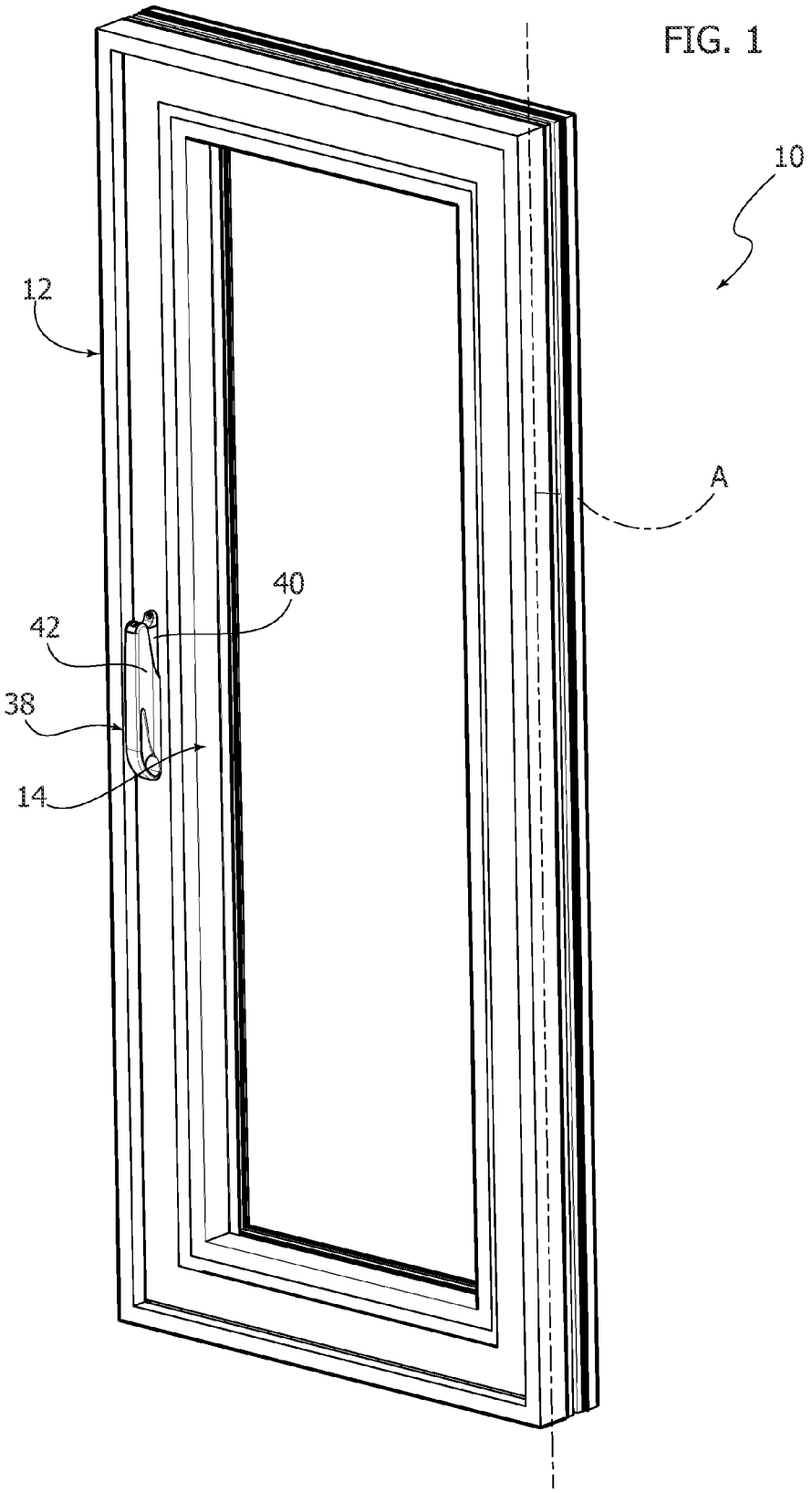
FIG. 1 is a perspective view illustrating a window with an outwardly-opening pivoting wing and equipped with an opening and closing device according to the present invention.
Figure 2:
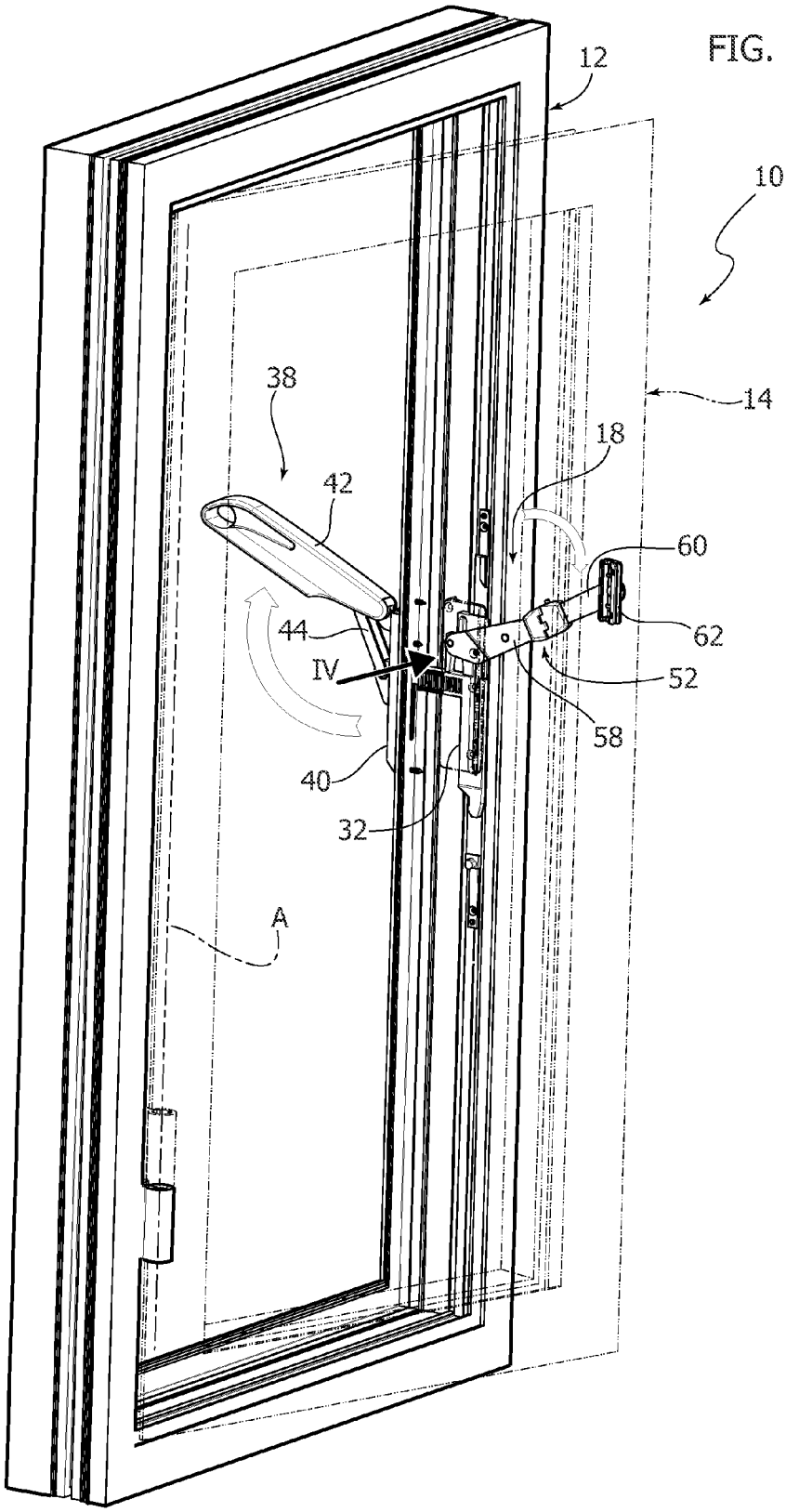
FIG. 2 is a perspective view illustrating the window of FIG. 1 in the open position, with the wing indicated by a dotted line.

With reference to FIGS. 1 and 2, numeral 10 indicates a window assembly comprising a fixed frame 12 and an outwardly-opening pivoting wing 14. The wing 14 is articulated to the frame 12 about an axis A. In the example illustrated in the figures, the articulation axis A of the wing 14 is vertical. However, the present invention is also applicable to wings articulated about horizontal axes. The frame 12 and the wing 14 are formed from extruded aluminium profiles equipped, in a conventional manner, with longitudinal slots.

Figure 3:
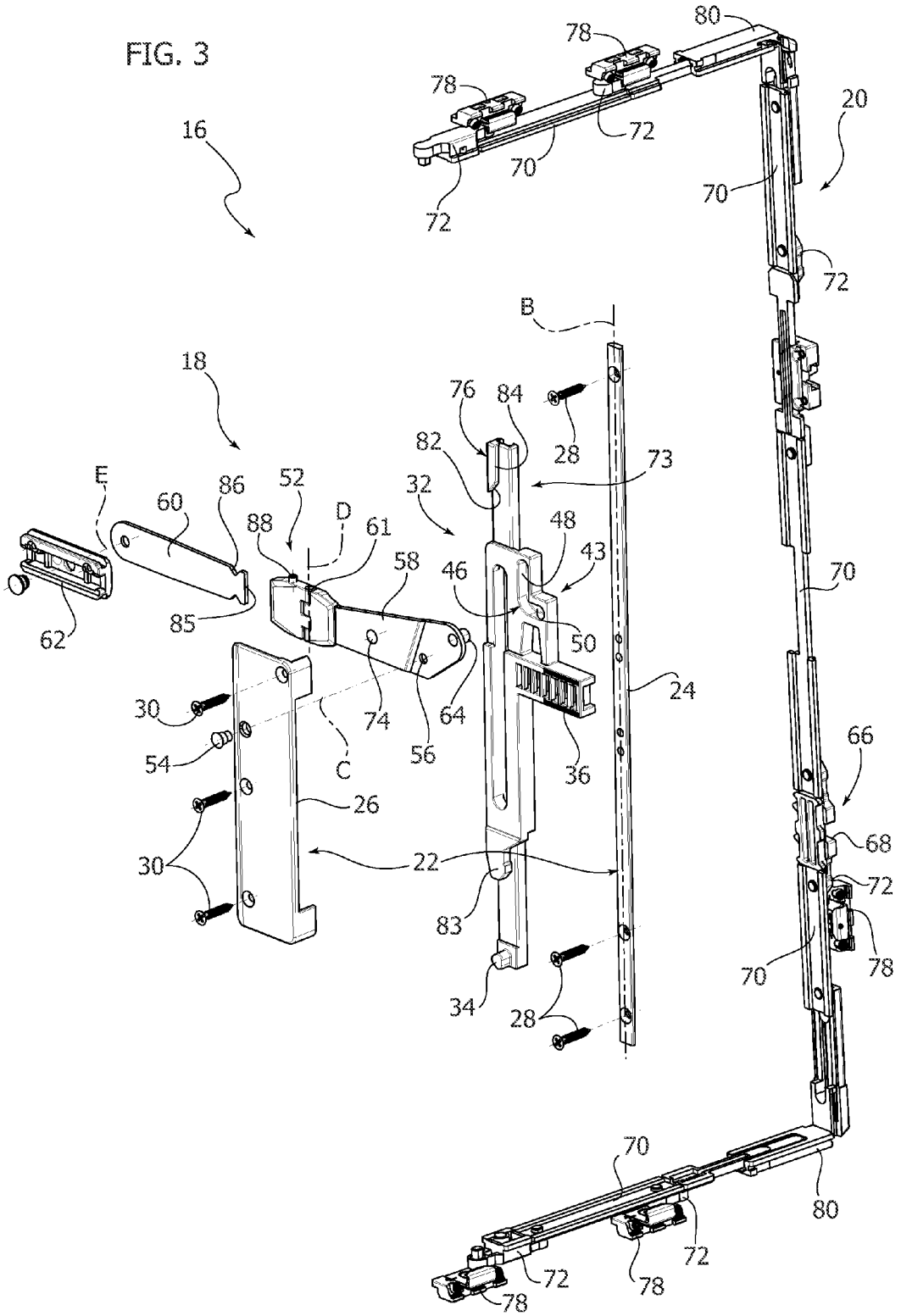
FIG. 3 is an exploded perspective view of a device for opening and closing the wing according to the present invention.

In FIG. 3, numeral 16 indicates, as a whole, a device for opening and closing the wing 14. The device 16 comprises a control assembly 18, intended for being mounted on the frame 12, and a locking assembly 20 intended for being mounted on the wing 14.

The control assembly 18 comprises a stationary support 22 including a fixed guide 24 and a fixed cover 26. The guide 24 and the cover 26 are intended for being attached to the frame 12 by means of respective screws 28, 30.

The control assembly 18 comprises a slide 32 movable along a rectilinear direction B parallel to the articulation axis A of the wing 14. The slide 32 is guided along the rectilinear direction B of the guide 24. In the assembled condition, the slide 32 is located between the cover 26 and the guide 24 and can only move in the rectilinear direction B. The slide 32 is movable in the direction B between a closed and locked wing position, a closed and unlocked wing position, and an open wing position.

The slide 32 comprises a drive pin 34 that controls the locking assembly 20 in the manner that will be described below.

The slide 32 has a transverse projection 36, which is coupled to an actuating device mounted on the frame 12. In FIGS. 1 and 2, numeral 38 indicates an actuating device configured to drive the control assembly 18. The actuating device 38 comprises a base 40 fixed to the frame 12 and a lever 42 articulated to the base 40, and movable between a lowered position (FIG. 1) corresponding to the closed and locked wing position, and a raised position (FIG. 2) corresponding to the open wing position. The lever 42 controls, via rods 44, a rectilinear movement of an actuating member attached to the transverse projection 36 of the slide 32. Thus, the movement of the lever 42 from the lowered position to the raised position, and vice versa, controls the movement of the slide 32 along the rectilinear direction B between the closed and locked wing position and the open wing position, and vice versa. In place of the actuating device 38 illustrated in the figures, any other actuating device can be used that is configured to control the movement of the slide 32 in the rectilinear direction.

The control assembly 18 comprises a pivoting arm 52 articulated to the stationary support 22 about an axis C, orthogonal to the rectilinear direction B. In the illustrated example, the arm 52 is articulated to the cover 26 by means of a pivot pin 54 which engages a hole 56 of the arm 52. Preferably, the arm 52 is formed by two sections 58, 60 articulated to each other by means of a hinge 61 about an axis D transverse with respect to the longitudinal direction of the arm 52. A first section 58 of the arm 52 is articulated to the cover 26, and a second section 60 of the arm 52 carries a runner 62 articulated to the arm 52 about an axis E parallel to the articulation axis C of the arm 52. The runner 62 is intended to engage, in a sliding manner, a groove of the wing 14, parallel to the rectilinear direction B.

With reference to FIGS. 3-8, the control assembly 18 comprises a transmission mechanism 43 associated with the slide 32 and the arm 52, configured to transform the rectilinear movement of the slide 32 along the direction B into a pivoting movement of the arm 52 about axis C. The transmission mechanism 43 comprises an essentially L-shaped cam 46, engaged by a control pin 64. In the embodiment illustrated in the figures, the cam 46 is formed in the slide 32 and the control pin 64 is attached to the first section 58 of the arm 18, but this arrangement could be reversed, i.e. the cam 46 could be formed on the arm 52 and the control pin 64 could be attached to the slide 32.

In the example illustrated, the cam 46 is constituted by a groove formed in the slide 32. The cam 46 has a first portion 48 parallel to the rectilinear direction B, and a second portion 50 orthogonal to the rectilinear direction B. The control pin 64 is parallel and spaced with respect to the pivot axis C of the arm 52, and is free to move along the cam 46.

With reference to FIGS. 3-8, the control assembly 18 comprises an auxiliary closing mechanism 73 associated with the slide 32 and the arm 52. The auxiliary closing mechanism 73 comprises a closing pin 74 cooperating with an inclined plane 76. In the example illustrated in the figures, the closing pin 74 is attached to the first arm section 58 and the inclined plane 76 is integrally formed with the slide 32. Alternatively, this arrangement could be reversed, i.e. the closing pin 74 could be attached to the slide 32 and the inclined plane 76 could be formed on the arm 52.

The closing pin 74 is arranged on the opposite side of the articulation axis C with respect to the control pin 64. The inclined plane 76 has a ramp surface 82 and a straight surface 84 parallel to the rectilinear direction B. The ramp surface 82 is inclined with respect to the rectilinear direction B and ends with an acute angle adjacent to the outer side of the frame 12.

As will become clear below, the auxiliary closing mechanism 73 is configured to apply an additional closing torque to the arm 52 when, during closing, the wing 14 is still open but very near to the frame 12. The additional closing torque provided by the auxiliary closing mechanism 73 provides the force required to compress the seals arranged between the wing 14 and the frame 12, without excessively stressing the control pin 64 and the pivot pin 54.

With reference to FIG. 3, the locking assembly 20 comprises a driver 66, which is intended to be mounted, in a sliding manner, in a longitudinal groove of the wing 14. The driver 66 has an engagement formation 68 that is engaged by the drive pin 34 of the slide 32 in the closed wing position. The locking assembly 20 comprises a plurality of transmission rods 70 connected directly or indirectly to the driver 66. A plurality of closing elements 72 are attached to the rods 70, which are intended to engage corresponding strikers 78 intended for being attached to the frame 12. In the illustrated embodiment, the closing elements 72 are arranged both along the vertical side and along the upper and lower horizontal sides of the wing 14. To transmit the movement from the driver 66 to the closing elements 72 arranged along the horizontal sides, two angular transmissions 80 are provided.

In the closed wing position, the movement in the vertical direction of the drive pin 34 of the slide 32 moves the driver 66 in a vertical direction. The movement of the driver 66 simultaneously moves all the closing elements 72 between a locking position and an unlocking position, and vice versa.

The upward movement of the driver 66 controls the disengagement of the closing elements 72 from the respective fixed strikers 78, while the downward movement of the driver 66 controls the engagement of the closing elements 72 with the respective fixed strikers 78.

Figure 4:
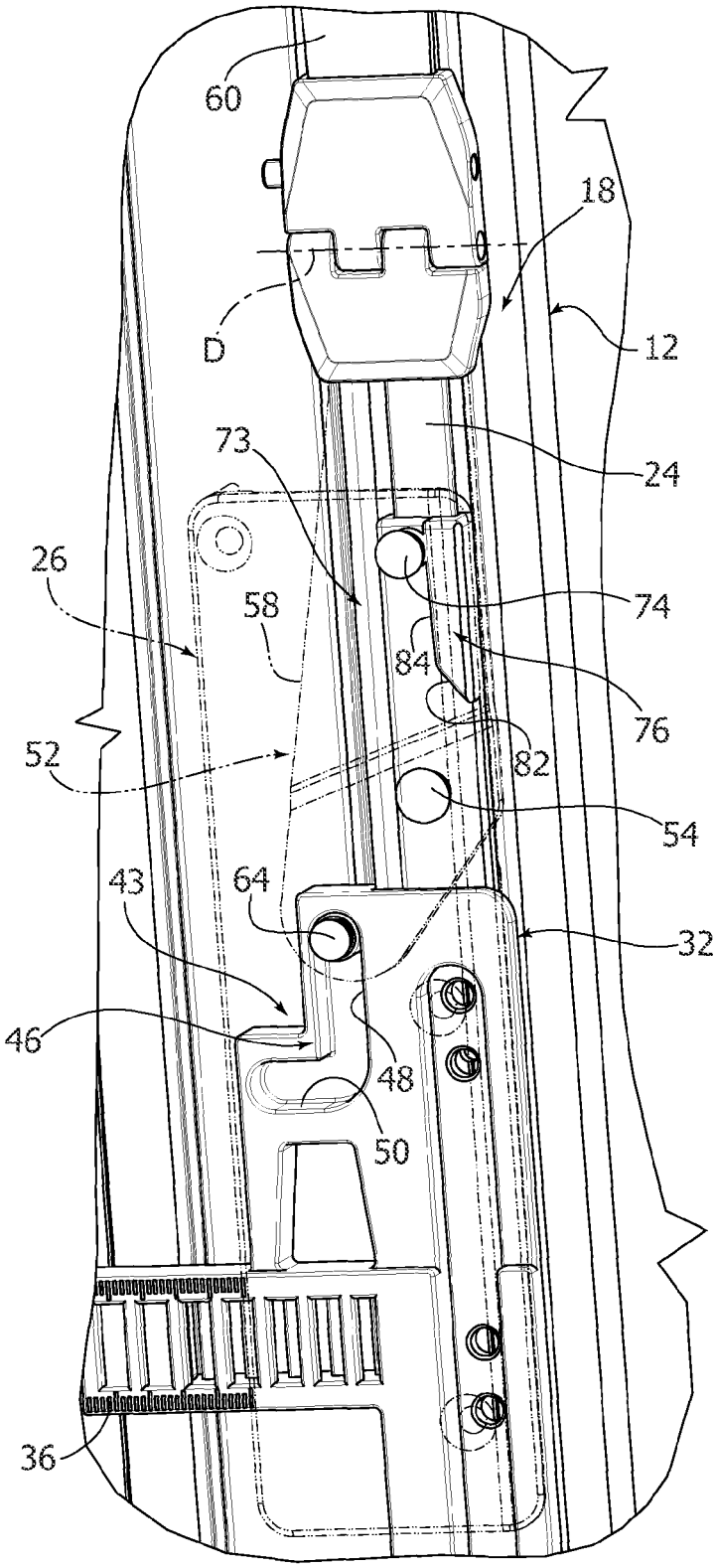
FIGS. 4, 5 and 6 are perspective views of the part indicated by the arrow IV in FIG. 2, illustrating the operation of the device according to the invention during opening of the wing.
Figure 5:
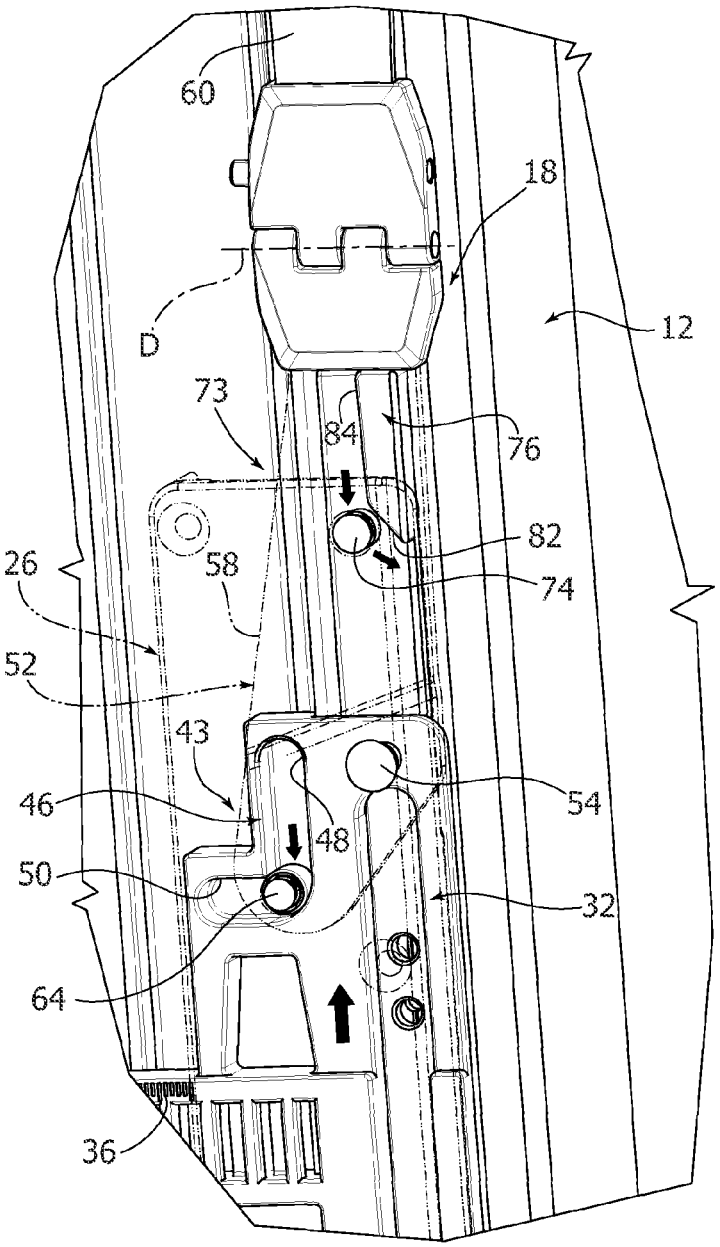
Figure 6:
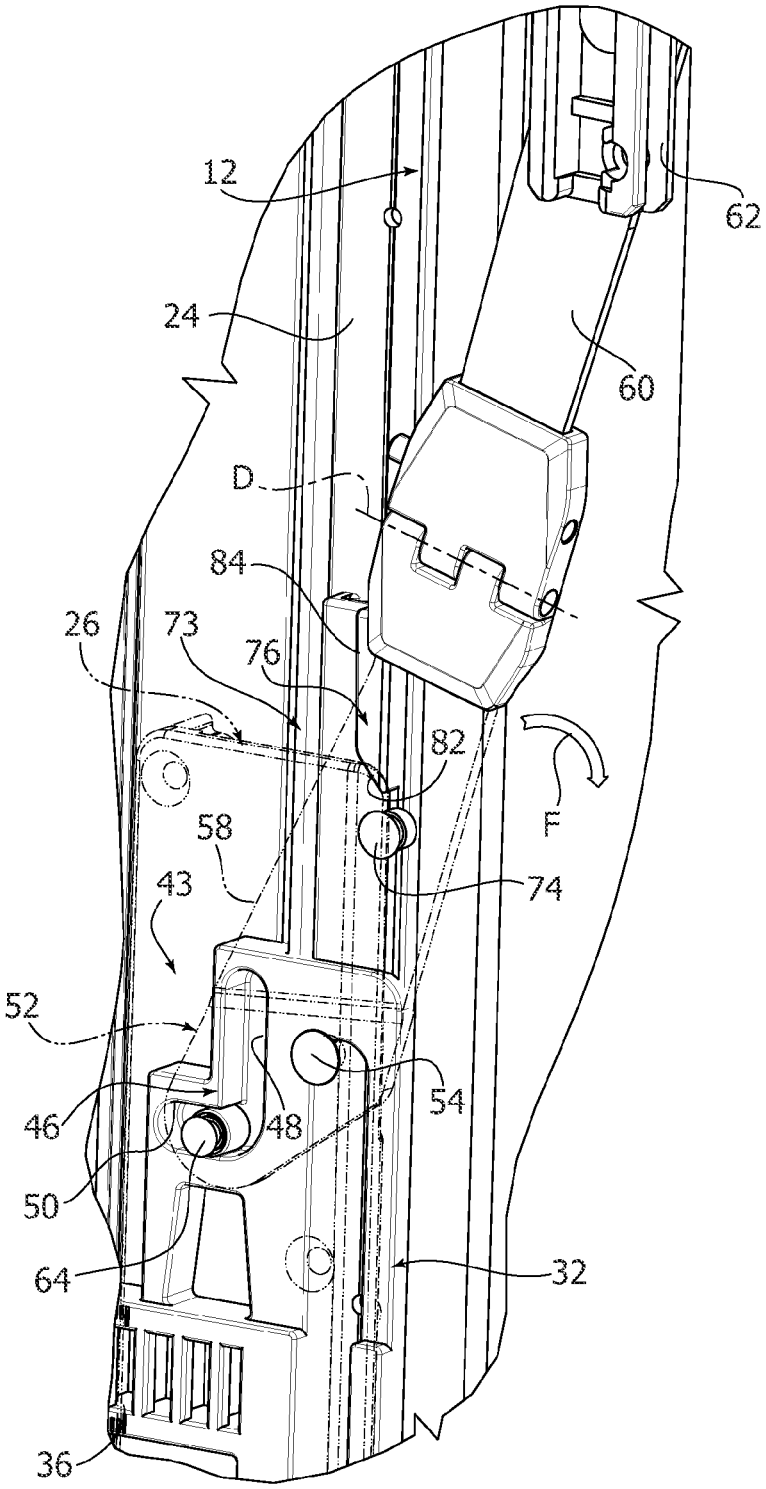

FIGS. 4, 5 and 6 show the operation of the control assembly 18.

In the position illustrated in FIG. 4, the slide 32 is in a fully lowered position, corresponding to the closed and locked wing position. In this position, the control pin 64 of the arm 52 engages the upper end of the first portion 48 of the cam 46. The arm 52 is oriented parallel to the guide 24. The drive pin 34 engages the engagement formation 68 of the driver 66. The driver 66 is in the lowered position and the closing elements 72 engage with the respective strikers 78. The closing pin 74 rests against the straight surface 84 of the inclined plane 76. The wing 14 is therefore in a closed and locked position.

Starting from the position of FIG. 4, the upward movement of the lever 42 of the actuating device 38 moves the slide 32 upward. If the actuating device 38 is of the gear-and-rack lever type, the upward movement of the slide 32 could be controlled by a downward movement of the lever.

In a first step of the upward movement of the slide 32, the control pin 64 of the arm 52 travels along the first portion 48 of the cam 46 from the top downwards. FIG. 5 illustrates the position of the control assembly 18 at the end of this first step of the upward movement of the slide 32. The control pin 64 of the arm 52 is at the bottom of the first portion 48 of the cam 46. In this first step, the arm 52 remains immobile. Indeed, in this first step, the control pin 64 engages the first portion 48 of the cam 46, that is parallel to the direction of movement of the slide 32. Therefore, the vertical movement of the slide 32 in this first step does not apply any force to the control pin 64. During the first step of the vertical movement of the slide 32, the drive pin 34 of the slide 32 moves the driver 66 of the locking assembly 20 upward. The upward movement of the driver 66 disengages the closing elements 72 from the respective strikers 78, and therefore unlocks the wing 14 from the frame 12. The closing pin 74 moves downward along the straight surface 84 of the inclined plane 76 and engages with the ramp surface 82 when the control pin 64 is at the bottom of the first portion 48 of the cam 46. In the position of FIG. 5, the wing 14 is in the closed and unlocked position.

Continuing the upward movement of the lever 42 (or downward movement with an actuating device of a different type), the slide 32 continues to move upward. In this second step of the upward movement of the slide 32, the control pin 64 of the arm 52 engages the second portion 50 of the cam 46, as illustrated in FIG. 6. In this case, the second portion 50 of the cam 46 applies a force to the control pin 64, which rotates the arm 52 about the axis C. Therefore, in this second part of the upward movement of the slide 32, the arm 52 pivots about the axis C in the direction indicated by the arrow F in FIG. 6. During pivoting of the arm 52 in the direction indicated by the arrow F, the closing pin 74 slides along the ramp surface 82 and disengages from the inclined plane 76. When the control pin 64 reaches the end of the second portion 50 of the cam 46, the wing 14 is in the fully open position.

Figure 7:
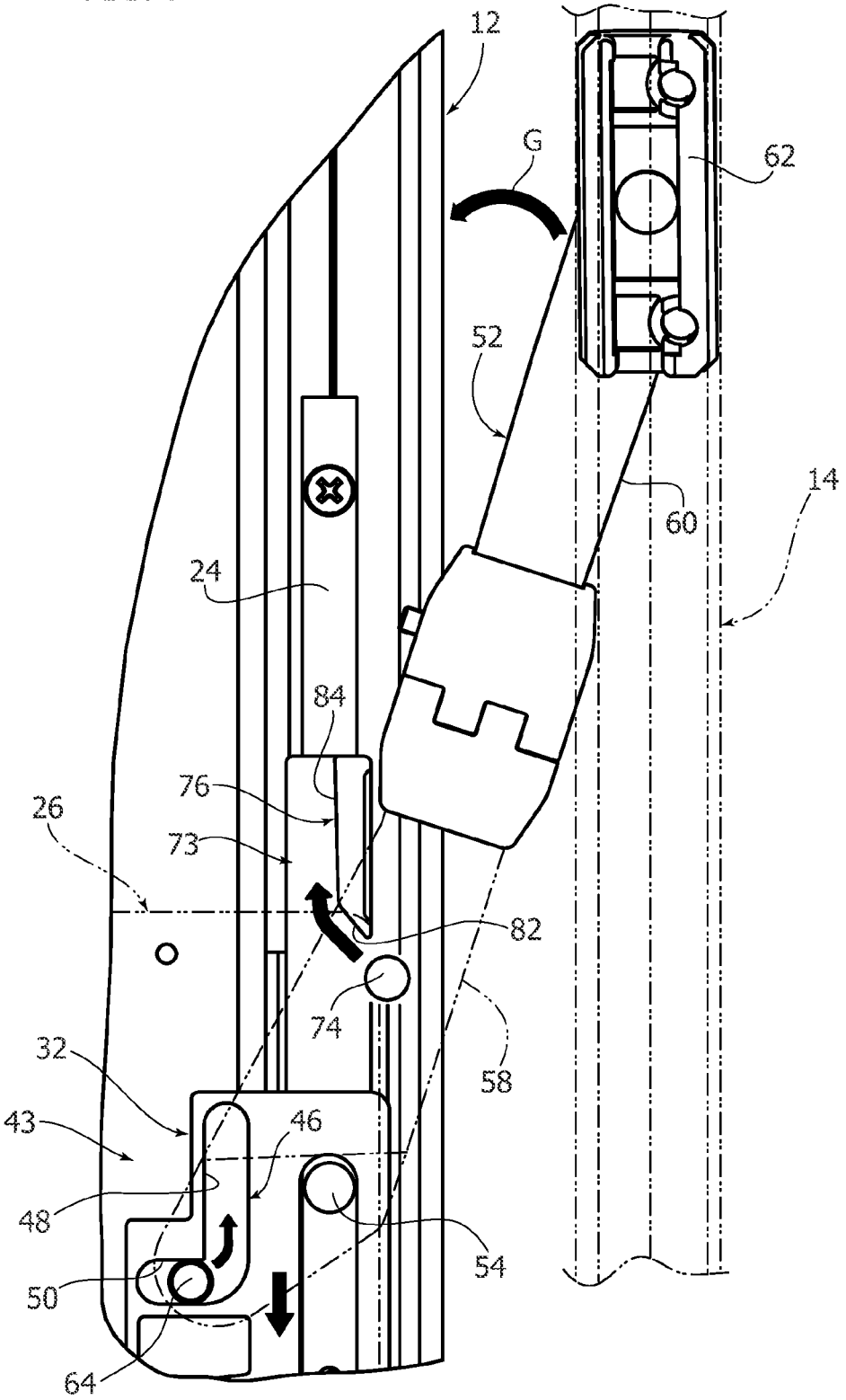
FIGS. 7 and 8 are front views of the part indicated by the arrow IV in FIG. 2, illustrating the operation of the device according to the invention during closing of the wing.

Starting from the fully open position, the closing maneuver of the wing 14 takes place in an inverse manner to that described previously. The lever 42 of the actuating device 38 is rotated from top to bottom, or from bottom to top with a different actuating device. With reference to FIG. 7, the slide 32 moves from the top downwards. In a first step of the movement from top to bottom of the slide 32, the control pin 64 engages the second portion 50 of the cam 46. In this step, the arm 52 rotates in the direction indicated by the arrow G in FIG. 7, from the outwardly-inclined position, corresponding to the open wing position, towards the vertical position corresponding to the closed wing position.

With reference to FIG. 7, when the wing 14 is still open but near to the frame 12, the closing pin 74 is facing the vertex of the ramp surface 82 of the inclined plane 76. Continuing the pivoting of the arm in the direction G, the closing pin engages the ramp surface 82. At this step, the downward movement of the slide 32 applies an additional closing torque to the arm 52 by means of the auxiliary closing mechanism 73. The additional closing torque increases the closing torque acting on the arm 52 in the final step of closing of the wing 14. This provides a greater closing force in the final step of closing of the wing 14, which is useful for compressing the seals arranged between the wing 14 and the frame 12 without excessively stressing the control pin 64 and the pivot pin 54.

Figure 8:
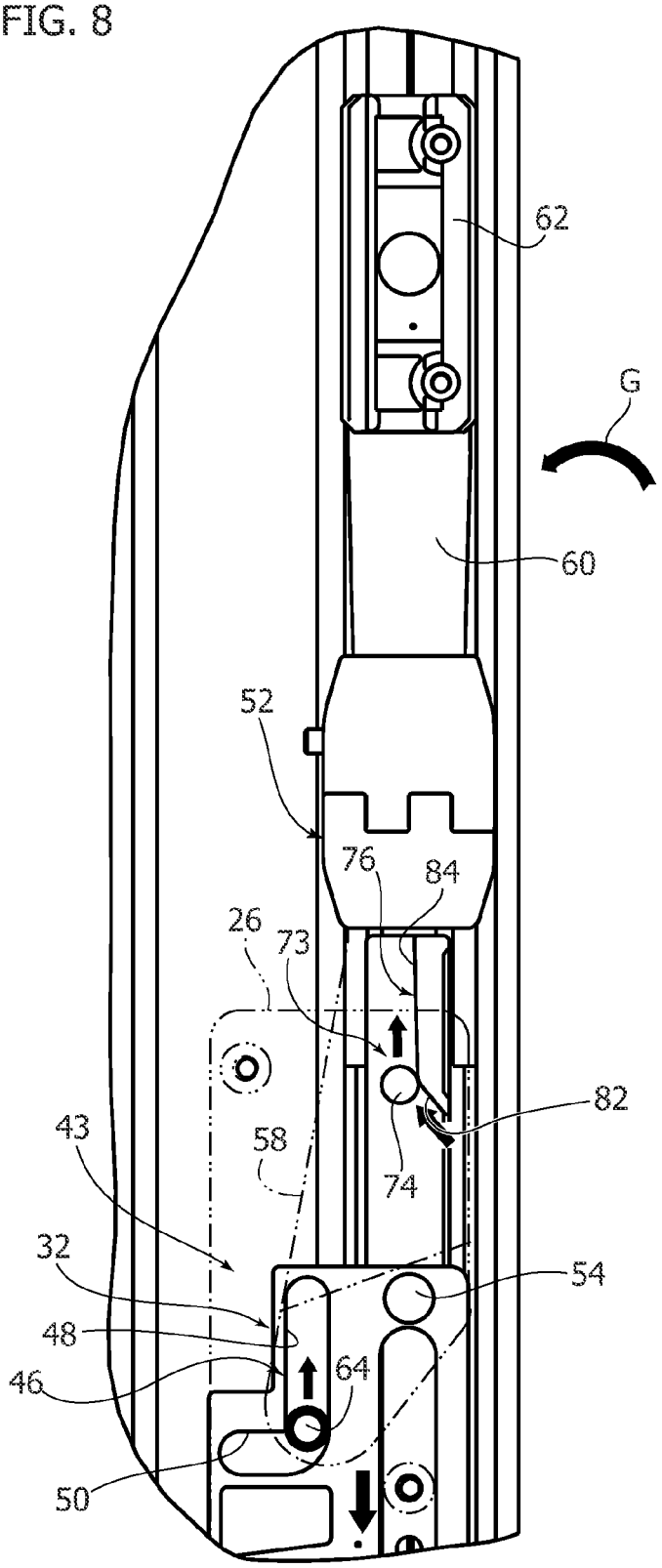

With reference to FIG. 8, when the arm 52 is in a vertical position, the control pin 64 engages the first portion 48 of the cam 46 and the closing pin 74 is at the end of the ramp surface 82 of the inclined plane 76. At this point, the wing is closed and the drive pin 34 of the slide 32 is inserted into the engagement formation 68 of the driver 66. Then, continuing the downward movement of the slide 32, the arm 52 remains immobile in a vertical position. The drive pin 34 moves the driver 66 from the top downwards. The movement of the driver 66 controls the simultaneous movement of the closing elements 72 from the disengagement position towards the engagement position.

The device according to the present invention does not necessarily have to be associated with a locking assembly 20 as previously described. In a simplified version, the control assembly 18 could lock the wing at just one closing point by means of a lug 83 of the slide 32 (FIG. 3) that, striker on the wing 14.

Preferably, the two sections 58, 60 of the arm 52 are disengageable from each other to allow opening of the wing 14 more than the opening angle allowed by the arm 52. With reference to FIG. 3, section 60 of the arm 52 is releasably attached to the hinge 61. In the illustrated example, section 60 of the arm 52 has a head 85 provided with a notch 86, which is engaged by a grub screw 88 that engages a threaded hole of the hinge 61. Unscrewing the grub screw 88, it is possible to disengage the section 60 from the hinge 61 and to open the wing fully for carrying out cleaning and maintenance.

Of course, without prejudice to the principle of the invention, the details of construction and the embodiments may vary widely with respect to those described and illustrated, without departing from the scope of the invention as defined by the following claims.

The invention claimed is:

1. A device for opening and closing a pivoting wing, comprising:

a stationary support attached to a fixed frame;

a slide mounted on the exterior surface of the stationary support, the slide being movable along the stationary support along a rectilinear direction between an open wing position, a closed wing position and a locked wing position, wherein the slide comprises a drive pin;

a pivoting arm articulated to the stationary support about an articulation axis, and having a distal end intended to be connected to the pivoting wing;

arm forming a transmission mechanism, the transmission mechanism the slide and the pivoting comprising an essentially L-shaped cam engaged by a control pin, the transmission mechanism converts the rectilinear movement of the slide along the rectilinear direction into a pivoting movement of the pivoting arm about the articulation axis;

a locking assembly mounted on the pivoting wing, comprising a sliding driver, a plurality of transmission rods connected to the sliding driver, a plurality of closing elements attached to the transmission rods and engaged to corresponding strikers in the closed wing position, attached to the fixed frame, the sliding driver having an engagement formation that is engaged by the drive pin of the slide in the closed wing position; and an auxiliary closing mechanism including a closing pin fixed to the pivoting arm, the closing pin cooperating with an inclined plane integral with the slide, wherein the inclined plane engages the closing pin when the pivoting wing is open and next to the fixed frame, in order to apply an additional closing torque to the pivoting arm during closing of the pivoting wing.

2. The device according to claim 1, wherein the stationary support comprises a fixed guide and a cover, wherein the slide is slidably engaged on the fixed guide and is movable between the fixed guide and the cover.

3. The device according to claim 2, wherein the pivoting arm is articulated to a pivot pin carried by the cover.

4. The device according to claim 1, wherein the cam has a first portion parallel to the rectilinear direction and a second portion orthogonal to the rectilinear direction.

5. The device according to claim 1, wherein the closing pin cooperates with a straight surface of the inclined plane in the closed wing position and the locked wing position.

6. The device according to claim 1, wherein the pivoting arm comprises a first section and a second section articulated to each other by means of a hinge about an axis transverse with respect to a longitudinal direction of the pivoting arm, one of the sections being disengageable from the hinge to allow complete opening of the pivoting wing.

* * * * *